US005159889A

United States Patent [19]

Price et al.

[11] Patent Number: 5,159,889

[45] Date of Patent: Nov. 3, 1992

[54] SEWING MACHINE WITH AUTOMATIC LATCH BACK DEVICE AND METHOD OF SEWING A PORTION OF A THREAD CHAIN

[75] Inventors: Elvin C. Price, Dacula; Preston B. Dasher, Lawrenceville, both of Ga.

[73] Assignee: Atlanta Attachment Company, Lawrenceville, Ga.

[21] Appl. No.: 674,389

[22] Filed: Mar. 25, 1991

Related U.S. Application Data

[63] Continuation-in-part of Ser. No. 630,841, Dec. 20, 1990.

[51] Int. Cl.[5] ..... D05B 1/20; D05B 65/00

[52] U.S. Cl. ..... 112/269.1; 112/253; 112/287; 112/288; 112/121.29; 112/DIG. 1; 112/162

[58] Field of Search ..... 112/288, 287, 253, 291–298, 112/300, 285, 269.1, DIG. 1, DIG. 3, 129, 130, 121.29, 162, 197

[56] References Cited

U.S. PATENT DOCUMENTS

| | | | |
|---|---|---|---|
| 3,223,059 | 12/1965 | Jacobs | 112/130 UX |
| 3,490,403 | 1/1970 | Boucraut | 112/287 |
| 3,593,991 | 7/1971 | Baron et al. | 112/121.29 X |
| 3,986,467 | 10/1976 | Hornkohl | 112/121.29 |
| 4,038,933 | 8/1977 | Marforio | 112/288 |
| 4,149,478 | 4/1979 | Sanvito et al. | 112/DIG. 1 X |
| 4,738,210 | 4/1988 | Keeton | 112/288 X |
| 4,829,920 | 5/1989 | Dippert et al. | 112/DIG. 1 X |

FOREIGN PATENT DOCUMENTS

| | | | |
|---|---|---|---|
| 1087600 | 10/1967 | United Kingdom | 112/288 |

*Primary Examiner*—Peter Nerbun

*Attorney, Agent, or Firm*—Hopkins & Thomas

[57] ABSTRACT

An apparatus and method for creating an overlock or 504 stitch wherein the excess thread chain (65) extending from the sewing machine needles (19) and the hollow chaining (32) to the previously sewn garment part (60) is stretched and is cut by thread chain cutter (70) to create a leading thread chain of predetermined length extending form the sewing machine needle and the hollow chaining tongue. When cut, the thread chain recoils toward the hollow chaining tongue, and a stream of air draws the free end of the thread chain into the hollow chaining tongue. When the next work piece is moved through the sewing area, the thread chain in the hollow chaining tongue is attached to the work piece and is progressively drawn out of the hollow chaining tongue and oversewn in the overlock stitch.

28 Claims, 4 Drawing Sheets

SEWING MACHINE WITH AUTOMATIC LATCH BACK DEVICE AND METHOD OF SEWING A PORTION OF A THREAD CHAIN

CROSS REFERENCE

This is a continuation-in-part of U.S. patent application Ser. No. 630,841, filed Dec. 20, 1990.

TECHNICAL FIELD

This invention relates to overlock stitch sewing machines and attachments therefor, and more specifically to a sewing machine which forms an overlock stitch in its work product with a thread chain extending between adjacent work products. A thread chain cutter automatically cuts the thread chain extending between the previously sewn work product and the sewing needles and an attachment forms a "latch back" in the work product of the leftover thread chain which has been severed from the previous work product. The work product is automatically stacked at the end of the work cycle.

BACKGROUND OF THE INVENTION

In the sewing of garment parts or other work products with a semi-automatic sewing machine that forms a overlock stitch in the garment parts, a chain of thread is created which extends from the rear of each garment part back toward the sewing needles by the continuing operation of the sewing machine after the garment parts pass through the machine. Typically, the trailing thread chain is severed after the garment part has moved beyond the sewing needles, leaving a tail of thread chain extending from the rear of the garment part, as well as leaving some excess thread chain extending from the sewing needle that will become attached to the next garment part that passes through the sewing machine.

In some of the prior overlock sewing systems, a scissors-type cutter is arranged so that the knife blades are adjacent and parallel to the path of travel of the garment through the sewing machine. The knife blades are positioned adjacent and to one side of an opening to a relatively large vacuum conduit (the diameter of the vacuum conduit is much greater than the thickness of the thread chain). As the garment part passes by the vacuum knife, a stream of air drawn through the vacuum conduit induces a length of the thread chain extending in a relaxed condition from the rear of the garment part to move into the vacuum conduit. The thread chain extending from the rear of the garment part is thereby extended across the knife blades and the blades trim the portion of the thread chain that reaches the cutter to an acceptably short length extending from the trailing edge of the just sewn garment part. This trimming of the thread chain also leaves a length of thread chain extending from the sewing needles and into the sewing area of the sewing machine.

To prevent the excess thread chain that extends from the needles of the sewing machine from being attached haphazardly to the leading edge of the next oncoming garment part and spoiling the appearance of the next succeeding garment part as it is sewn, it is desirable to position this excess thread chain so that it will be oversewn or "latched back" into and substantially hidden by the stitching formed in the next garment part precisely at the beginning of the stitching in that garment part. In the absence of such a "latch back" operation, the excess thread chain creates a knot or a chain of threads that extends from the leading edge of the subsequent garment part, and this knot or excess thread chain might have to be trimmed away from the garment, which requires additional time and tends to weaken the stitched seam at its cut end.

There are prior art disclosures which address the problem of positioning and oversewing the excess thread chain extending from the needles of the sewing machine into the subsequent garment part. For example, U.S. Pat. No. 4,679,515 of Keeton describes an apparatus which works to oversew the excess thread chain by severing the thread chain, blowing the free end of the thread chain extending from the sewing needles around and away from the sewing area with a stream of air, and snagging the excess thread chain with a mechanical finger or other means, thereby holding the thread chain in such a position that it should be oversewn into the next garment part. However, there are certain practical difficulties with this type arrangement, most notably the difficulty in correctly positioning the beginning of the excess thread chain at the very beginning of the next garment part. Another shortcoming of the prior art is that the mechanical device does not always snag the excess thread chain successfully, making the apparatus inefficient to use in a high production environment. Such prior art further requires a relatively large number of moving parts to perform the latch back sewing function, while generally a device which has fewer moving parts tends to be more reliable and simpler to construct and maintain.

U.S Pat. No. 4,038,933 of Marforio discloses a sewing machine with a vacuum operated device for latching back excess thread chain at the beginning of forming a chain stitch in a garment. A knife severs the thread chain and an air stream flows into a hollow chaining tongue and draws the severed thread chain extending from the needles into the hollow chaining tongue. When the sewing function resumes, the thread chain is progressively pulled out of the chaining tongue and becomes part of the stitch formed in the work product. Devices made according to the teachings of Marforio generally fail to latch back thread chains into the chain stitch of the next garment with a high degree of reliability at least in part because Marforio does not disclose a means for ensuring that the thread chain that would be drawn into the hollow chaining tongue is of a predetermined length. Applicant has discovered that if the thread chain to be drawn into the hollow chaining tongue is too long, it cannot be drawn into the hollow chaining tongue reliably. Also, if the thread chain to be drawn into the hollow chaining tongue is too short, it may be too stiff to respond to the stream of air that attempts to turn the thread chain toward the chaining tongue and the thread chain can become unraveled, producing a weakened and unattractive latch back stitch. Moreover, Marforio discloses using a Venturi air flow constriction to create a source of reduced pressure for drawing the severed thread chain with an air stream into the hollow chaining tongue. Such an arrangement is functional but it is not very desirable because this type system usually creates a loud noise in operation and consumes large volumes of compressed air to create the desired intermittent air stream and fails to produce a large enough volume of air flow through the hollow chaining tongue to reliably move the excess thread chain into the hollow chaining tongue.

Thus, it is seen that a need exists for a sewing machine assembly which will "latch back" leftover thread chain severed from a previously sewn garment part and extending from the sewing needles precisely at the beginning of the stitching of a second garment part, while maintaining a high degree of reliability of operation.

SUMMARY OF THE INVENTION

Briefly described, the present invention comprises a process and apparatus for oversewing onto an oncoming garment part or other work piece the leftover thread chain extending from the sewing machine needles of an overlock stitch sewing machine which has been severed from a previously sewn garment part.

A feature of the preferred embodiment of the invention is that the free end portion of the excess thread chain cut from the previous garment part and extending from the sewing needles is cut to a predetermined length and is drawn by an air stream into a hollow chaining tongue of the throat plate of the sewing machine. The thread chain is held in the hollow chaining tongue by the stream of air until the next garment part is advanced beneath the sewing needles and the proximal end of the thread chain is attached to the leading edge of the garment part, whereupon the free end portion of the thread chain is progressively pulled by the advancing garment part from the inside of the hollow chaining tongue and sewn into the stitch being formed in the garment part.

By cutting the thread chain extending from the sewing needles to a predetermined length prior to inducing the thread chain to be drawn into the hollow chaining tongue, the thread chain is drawn into the chaining tongue with a very high degree of reliability. Preferably, the knife that cuts the thread chain is positioned ½ to 1½ inches from the sewing needles so as to cut the thread chain to the desired length that is long enough to be flexible and turn with the stream of air toward the hollow chaining tongue, yet short enough to be moved by the stream of air and not unravel.

Another feature of the preferred embodiment of the invention is that the thread cutter provided for cutting the thread chain to the specified length is oriented to cut perpendicular to the path of travel of the garment part through the sewing machine. The thread cutter includes knife blades positioned across the path of the thread chain extending between the rear edge of the previously sewn garment part and the sewing needles so that the thread chain can be made taut as the thread chain is being cut. This is important because the thread chain has some elasticity and upon cutting the taut thread chain, the now severed thread chain portions tend to spring back away from the position where the cutter severed the thread chain and move toward the opposite ends of the thread chain. Thus, the portion of the thread chain extending from the sewing needles toward the cutter recoils toward the sewing needles. This recoil action of the cut thread chain moves the cut thread chain toward the hollow chaining tongue in a relaxed, flexible condition and helps move the thread chain into the air stream moving into the hollow chaining tongue.

During the time that the chain stitch passage of the hollow chaining tongue is exposed to reduced air pressure and the stream of air enters the hollow chaining tongue, the sewing action of the sewing machine is continued for a small number of stitches to agitate the thread chain extending from the needles and the chaining tongue to help the excess thread chain to be drawn into the hollow chaining tongue by overcoming the stiffness of the thread chain. This continued sewing action also makes sure that the threads extend from the needles and about the chaining tongue, so that the proximal end of the excess thread chain physically surrounds the chaining tongue, assuring that the thread chain is located in the stream of air entering the hollow chaining tongue. The sewing action is then halted and the stream of air is terminated until the operator feeds the next garment part to the sewing needles of the sewing machine.

As the sewing action begins for the next garment part, the flow of air into the hollow chaining tongue is established and additional excess thread chain is likely to be created about the chaining tongue before the sewing needles first engage the oncoming garment part. This additional excess thread chain also is formed about the chaining tongue. As the oncoming garment part approaches the sewing needles, the excess thread chain still wrapped about the chaining tongue will be pushed off the distal end of the chaining tongue by the leading edge of the garment part and drawn into the hollow chaining tongue by the air stream. This drawing off of the additional excess thread chain continues until the sewing needles first engage the next garment part and the threads are formed in an overlock stitch in the leading side edge of the garment part, at which point the garment part itself begins to draw the excess thread chain back out of the hollow chaining tongue into a position along the lower surface of the garment part against the direction of the stream of air entering the hollow chaining tongue.

As the sewing of the garment part progresses, the stitches are first formed about the chaining tongue as well as in the garment part so that as the excess thread chain is pulled by the moving garment part out of the chaining tongue the stitching slips off the end of the chaining tongue and surrounds the excess thread chain being drawn out of the chaining tongue and captures the excess thread chain adjacent the lower surface of the garment part. As the garment part progresses further through the sewing machine this process of drawing the excess thread chain back out of the hollow chaining tongue continues until all of the excess thread chain is drawn back out of the hollow chaining tongue and is oversewn or "latched back" into the garment part.

The air stream is terminated shortly after the sewing machine starts its sewing function so that the thread chain is progressively but gently pulled from the hollow chaining tongue against the flow of the stream of air entering the chaining tongue during the initial sewing function yet the requirements of the vacuum system to maintain the air stream are minimized when the thread chain has been pulled out of the chaining tongue by terminating the movement of air into the chaining tongue.

Another feature of the invention is that the hollow chaining tongue is connected in fluid communication to a suitably sized vacuum canister, with the vacuum canister being at least partly evacuated by a low-volume, low-noise vacuum generator. The vacuum canister acts as a reduced pressure reservoir which makes a large volume of reduced pressure air available from the low capacity vacuum generator for causing the thread chain to be drawn within the hollow chaining tongue.

Another feature of the invention is a conveyor and stacker which place the completed work product in orderly stacks. The conveyor operates at a velocity which is the same as the velocity of the sewing machine until the trailing edge of the garment part passes beyond the sewing needles, and then the conveyor velocity increases to stretch the thread chain extending from the rear edge of the garment part to the sewing needles, and after the thread chain has been stretched, the thread cutter cuts the thread chain, resulting in the recoil of the cut ends of the thread chain, as previously described.

Thus, it is an object of this invention to provide a system for producing high quality stitching and seams in garments and other work products.

Another object of this invention is to provide an improved system for forming "latch back" overlock stitching in garments and similar work products with a high degree of reliability.

Another object of the invention is to provide more attractive leading ends of seams in garments and the like in that the seams are free of any knots of threads or of unconnected thread chains.

Another object of this invention is to provide an automated system for creating tension in thread chains extending from a previously sewn work product back to the needles of a sewing machine and cutting the thread chain when taut.

It is another object of this invention to provide a system for producing high quality chain stitching in garments and the like while permitting workers with less experience and skill to produce the quality garments and articles. This is accomplished by virtue of the fact that the operator need not position the garment to be sewn in any particular manner in order to achieve a proper latch back stitch. Rather, the apparatus ensures that the latch back stitch is properly positioned.

It is another object of this invention to provide higher production rates in the fabrication of garments and the like by eliminating the need for trimming leading knots of threads and thread chains from garments.

Another object of the invention is to provide an improved stacking system that works in conjunction with a latch back attachment of an overlock sewing machine.

Other objects, features and advantages of the invention will become apparent upon reading the following specification when taken in conjunction with the accompanying drawings.

DETAILED DESCRIPTION

Figure 1:
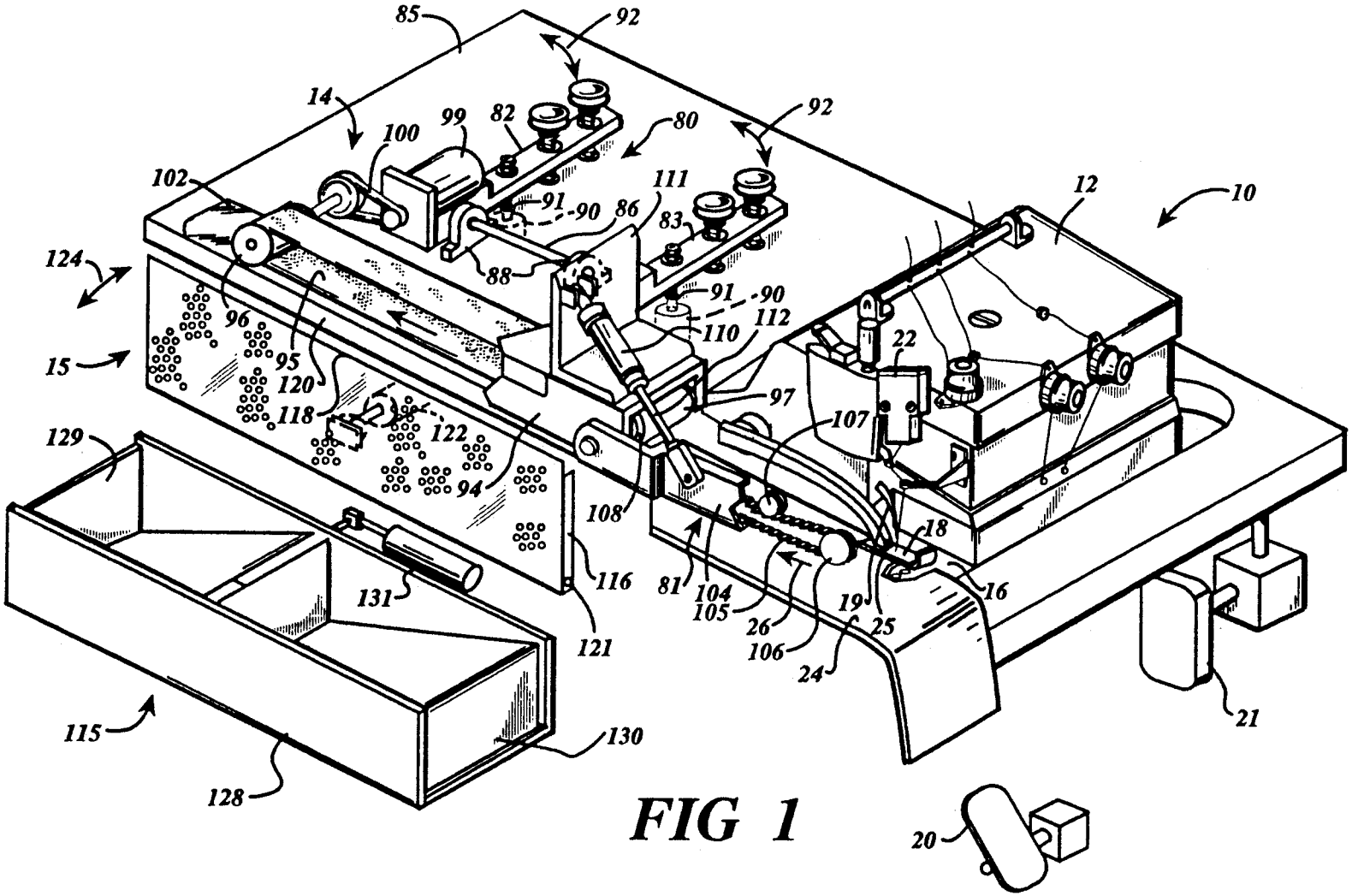
FIG. 1 is a perspective illustration of the sewing machine, conveyor and stacker.

Referring now in more detail to the drawings, in which like numerals indicate like parts throughout the several views, FIG. 1 illustrates a sewing machine assembly 11 which includes a sewing machine 12, conveyor 14 and stacker 15. The sewing machine can be of conventional construction, such as a Wilcox & Gibbs overlock machine which functions to form an overlock stitch, also known as stitch type 504 of the Federal Standard Stitches, Seams, and Stitchings, Fed. Std. No. 751*a*, Jan. 25, 1965. The sewing machine includes a throat plate 16, a presser foot 18, with feed dogs (not shown) arranged to protrude cyclically up through the throat plate, with the presser foot 18 arranged to press the work piece down against the throat plate 16 so that the work piece will be cyclically advanced by the feed dogs. The upper sewing needle 19 cooperates with the lower sewing needles 19' (not shown) to form an overlock stitch about the chaining tongue of the throat plate 16.

It is noted that the term "lower sewing needles" refers to the conventional loopers utilized in an overlock sewing machine. The operator controls the sewing machine with the use of a conventional foot switch 20 and/or a leg switch 21, as is conventional. In addition, a photoelectric sensor 22 functions as a detector for detecting the movement of the work pieces through the sewing machine. In general, the operator places a work piece on the working surface 24 and advances the leading edge of the work piece beneath the presser foot 18 and over the throat plate 16 and then actuates switch 20 to lower the presser foot and begin the sewing operation. As will be discussed in more detail hereinafter, the work piece moves across the sewing area 25 which is in the vicinity of the pressure foot 18 and throat plate 16, along a sewing path as indicated by arrow 26, so that the work piece becomes engaged by the conveyor assembly 14 and is later stacked by the stacker assembly 15.

Figure 2:
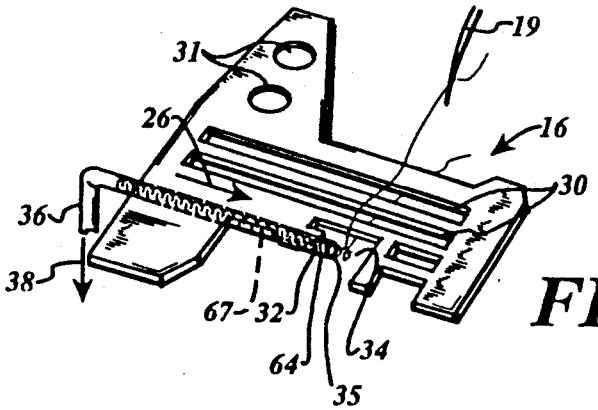
FIG. 2 is a perspective view of a lower portion of the work piece, showing how the overlock stitch is formed first about both the hollow chaining tongue and the work piece before the threads of the stitch are slipped off the hollow chaining tongue.

As shown in FIG. 2, the throat plate 16 includes longitudinal slots 30 which permit the feed dogs (not shown) to emerge upwardly from beneath the throat plate and to engage the work product to be moved across the throat plate. Additionally, mounting holes 31 are formed in the throat plate for rigidly mounting the throat plate to the sewing machine. Chaining tongue 32 is formed at an edge of the throat plate and protrudes into an open space 34 of the throat plate. Chaining tongue 32 is hollow and defines an opening 35, and a passageway extends from opening 35 rearwardly through the chaining tongue, and the passageway communicates with air conduit 36. As indicated by arrow 38, a stream of air flows through air conduit 36 and hollow chaining tongue 32, with the stream of air entering the opening 35 of the chaining tongue.

Figure 3:
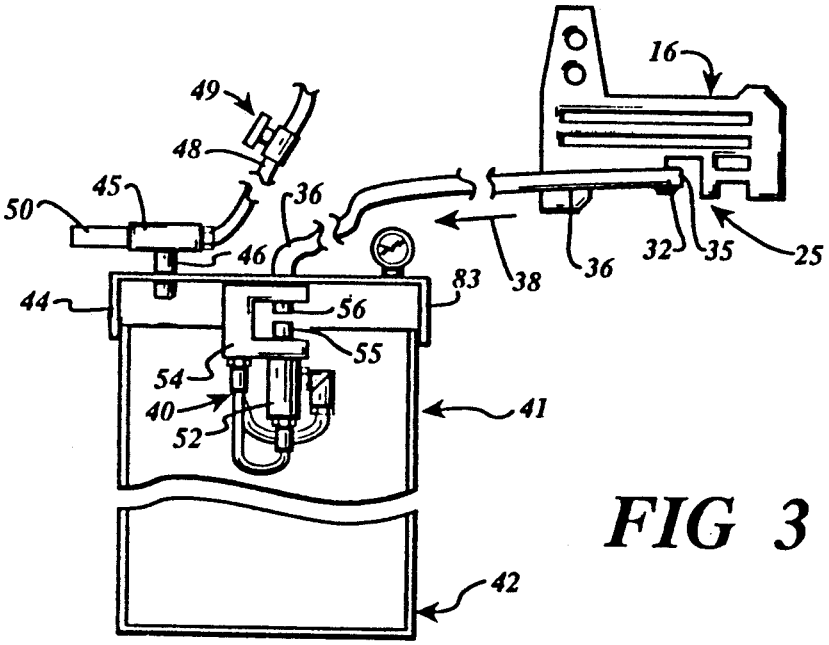
FIG. 3 is a schematic illustration of the vacuum canister of the air flow control system.

As illustrated in FIG. 3, the stream of air flowing through the hollow chaining tongue 32 of the throat plate 16 is controlled by internal control valve assembly 40 in vacuum canister 41.

Vacuum canister 41 comprises a cylindrical housing 42 with a bottom wall, a cylindrical side wall and a lid 44 extending over the upper opening of the housing 42. A Venturi air flow inducement constriction 45 has its inlet conduit 46 in communication with housing 42 of vacuum canister 41, and its pressure line 48 connected to a source of compressed air (not shown). Valve 49 controls the movement of high velocity air through the high pressure line 48, to the Venturi 45, and through the outlet 50 to the atmosphere.

Figure 4:
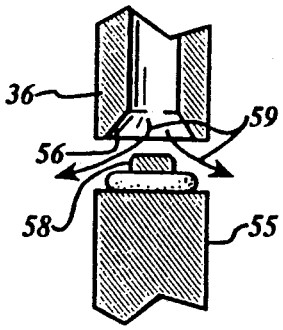
FIG. 4 is a detail illustration of the control valve positioned inside the vacuum canister of FIG. 3.

Internal control valve 40 is suspended from the lid 44 of the canister 41. Cylinder 52 is suspended from the C-shaped mounting block 54 and its cylinder rod 55 carries valve element 58 (FIG. 4) and moves the valve element toward and away from a valve seat 56. The valve seat 56 communicates with air conduit 36. As shown in FIG. 4, valve element 58 is mounted on the end of cylinder rod 55 and cooperates with valve seat 56 to open and close air conduit 36. When the valve of FIG. 4 is opened, the air flow as indicated by arrows 59 tends to remove any debris from the surface of valve element 58, assuring that the valve will close tightly on each cycle.

As best illustrated in FIG. 3, when internal control valve 40 is open, the reduced air pressure within canister 41 draws a stream of air through the hollow chaining tongue 32, so as to induce a flow of air in the vicinity of the sewing area 25 to move into the opening 35 of the hollow chaining tongue.

As illustrated in FIG. 2, when a chain of thread has been formed by sewing needles 19, 19' the stream of air induced by the vacuum canister 41 through the hollow chaining tongue 32 draws the loose end 67 of the thread chain into the hollow chaining tongue.

Figure 5:
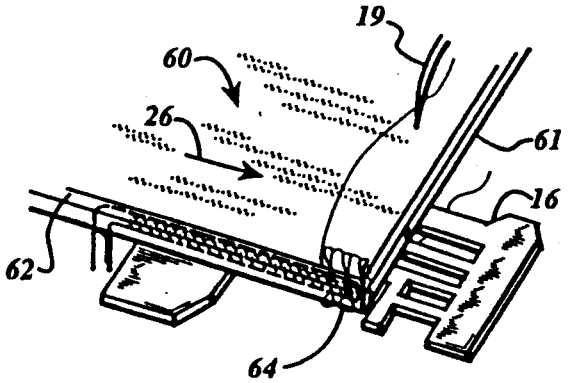
FIG. 5 is a perspective view of the throat plate and the work piece as the work piece is being sewn with an overlock stitch and as the work piece progressively draws the leading thread chain out of the hollow chaining tongue.
Figure 6:
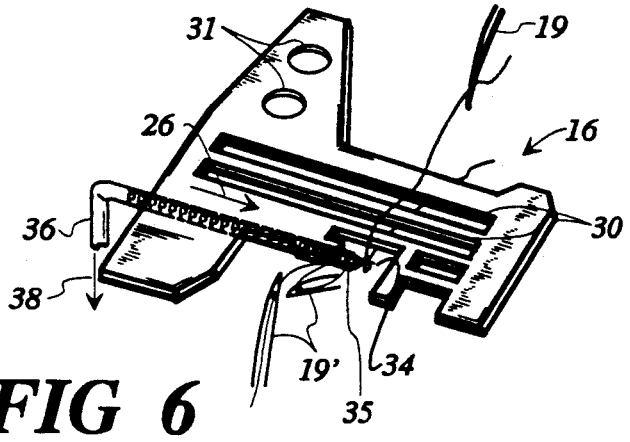
FIG. 6 is a perspective illustration of the throat plate showing the leading thread chain drawn into the hollow chaining tongue.

As shown in FIGS. 2, 5 and 6, when a work piece 60 is advanced by the operator or by the conveyor system 14 across the throat plate 16 along the sewing path 26, the needles 19 will have formed an overlock stitch 64 about the distal end of the chaining tongue 32. As the work piece 60 moves into the sewing area and is contacted by the needles so that an overlock stitch is formed at the leading edge 61 along the side edge 62 of the work piece, the thread chain in the hollow chaining tongue will begin to move in unison with the work piece 60 against the direction of the air flow into the hollow chaining tongue, so that the work piece draws the thread chain out of the hollow chaining tongue.

In the meantime, as illustrated in FIG. 6, the overlock stitch 64 is formed simultaneously about the side edge 62 of the work piece 60 and about the distal end of the chaining tongue 32, and the movement of the work piece 60 forwardly along the sewing path 26 causes the overlock stitch to slip off the end of the chaining tongue. In the meantime, the trailing thread chain 67 being pulled out of the chaining tongue will have been surrounded by the newly formed portion of the overlock stitch, so that the trailing thread chain 67 is oversewn or "latched back" within the overlock stitch.

Figure 7:
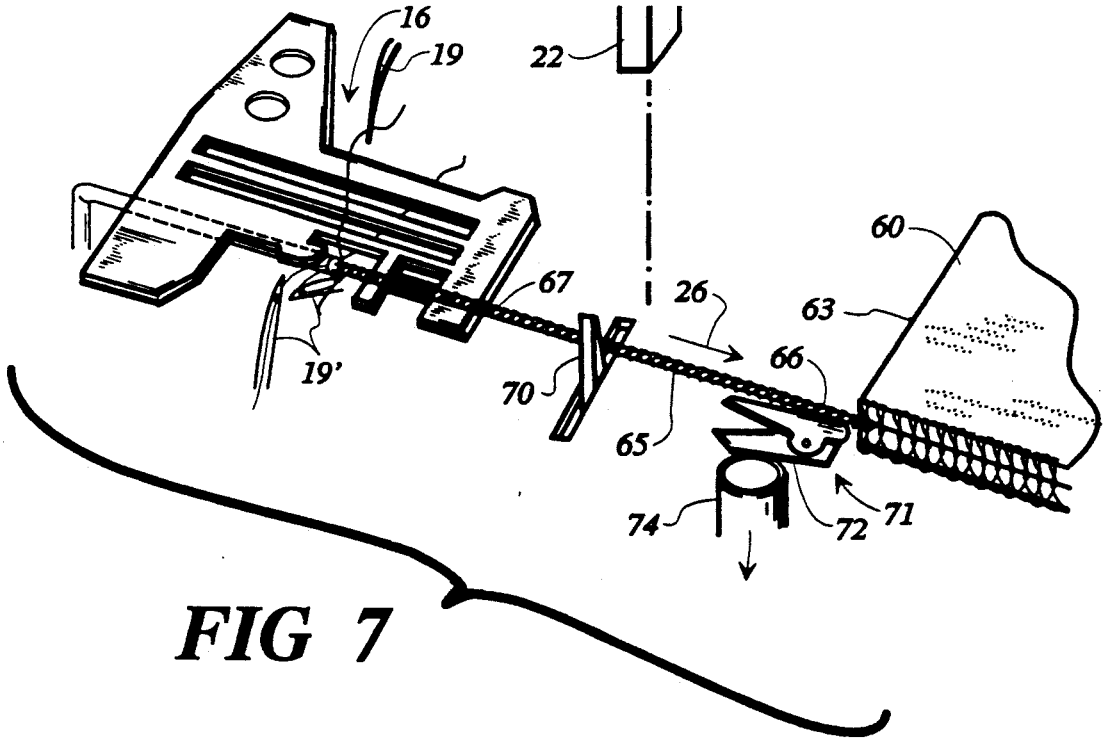
FIG. 7 is a perspective view of the throat plate, chain cutter and thread trimmer, showing how the thread chain is cut and trimmed from the previously sewn work piece.

As illustrated in FIG. 7, when the work piece 60 moves further along the sewing path 26, the photoelectric detector 22 will detect that the trailing edge 63 of the work piece is moving out of the sewing area 25. In the meantime, the sewing machine sews off the work piece 60 and a thread chain 65 is formed between the trailing edge 63 of the work piece back to the chaining tongue 32 and sewing needles 19, 19'. The thread chain 65 extends along the sewing path 26, and a thread chain cutter 70 is positioned in the path 26 and arranged to cut across the path, to sever the thread chain 65 into a severed trailing thread chain 66 extending rearwardly from the trailing edge 63 of the previously sewn work piece 60 and a severed leading thread chain 67 that extends to the chaining tongue 32 and the sewing needles 27. Thread chain cutter 70 is of conventional construction and is positioned at a distance between ½ inch and 1½ inches from the opening 35 of the chaining tongue 32.

For some garments it is not important that the trailing thread chain 65 be removed from the work piece 60; however, for those garments that require removal of the trailing thread chain the thread chain trimmer 71 is provided. Thread chain trimmer 71 is located beside the sewing path 26 and includes cutter 72 and vacuum conduit 74. When thread chain cutter 70 severs the thread chain 65 as previously described, the severed trailing thread chain 66 will be drawn by the flow of air laterally of the sewing path 26 into the vacuum conduit 74 and will enter the bite of the thread chain cutter 72. This causes most of the severed trailing thread chain 66 to be trimmed away from the trailing edge 63 of the work piece 60.

As the work piece 60 enters the sewing area 25, the work piece is engaged by the conveyor assembly 14 (FIG. 1), and the conveyor assembly moves the work piece at an initial velocity equal to the stitching rate of the sewing machine. This rate of movement imparted by the conveyor assembly 14 to the work piece continues until the conveyor 14 has moved the trailing edge 63 of the work piece 60 beyond the throat plate 16, whereupon the movement of the work piece 60 beyond the sewing area 25 is detected by the photoelectric detector 22. In response to the detection by the detector 22 of the trailing edge 63 of the work piece 60, the operational speed of the conveyor assembly 14 is increased so that the movement of the work piece 60 is accelerated away from the sewing area 25, now moving at a velocity greater than the rate of formation of the overlock stitch about the chaining tongue 32. This causes the thread chain 65 to be stretched (FIG. 7).

After the thread chain 65 has become stretched, and in response to the detection by the photoelectric detector 22 of the trailing edge 63, chain cutter 70 is actuated and, if desired, thread chain trimmer 71 is actuated. When thread chain cutter 70 is actuated, the taut thread chain 65 is severed so as to form the severed trailing thread chain 66 that extends to the trailing edge 63 of the work piece 60 and the severed leading thread chain 67 that extends back to the chaining tongue 32 and sewing needles 19. The severing of the taut chain 65 causes its ends to recoil or snap back toward the work product 60 and toward the chaining tongue 32 and sewing needles 19.

In the meantime, internal control valve 40 of the vacuum canister 41 (FIG. 3) will be opened in response to the detection by the photoelectric detector 22 of the movement of the trailing edge 63 of the work produce 60, so that a stream of air is drawn into the hollow chaining tongue 32 and into the vacuum conduit 74. As the leading thread chain 77 recoils the air stream moving into the hollow chaining tongue tends to draw the thread chain into the chaining tongue and the severed trailing chain 66 is induced by the flow of air into the vacuum conduit 74 to move into the bit of the cutter 72, thereby trimming the trailing thread chain. Further, the sewing machine will resume its sewing operation for a short duration, sufficient to form between two and five stitches of the overlock stitch about the chaining tongue. This assures that the proximal end of the leading thread chain 67 is mounted on the distal end of the chaining tongue 32, and the movements of the sewing needles tend to agitate the loose portion of the leading thread chain 67, thereby assuring that the thread chain is exposed to the stream of air moving into the hollow chaining tongue. This assures that the leading thread chain 67 always enters the hollow chaining tongue 32. Thus, the leading thread chain 67 resumes the position illustrated in FIG. 2, and is ready for the next work piece.

As illustrated in FIG. 1, the conveyor assembly 14 comprises main conveyor 80 and tilt conveyor 81. Main conveyor 80 is mounted on a pair of support arms 82 and 83, with the support arms being parallel to one another and spaced above the work table 85. Support arms 82 and 83 are mounted at the ends of support rod 86, and the support rod is rotatably supported above the surface of the work table 85 by bearings 88. Pneumatic cylinders 90 are mounted beneath the work table 85 and the cylinder rods 91 extend through openings in the table and are connected at their distal ends to the support arms 82 and 83. The cylinders 90 and their rods 91 rock the support arms 82 and 83 about the support rod 86 as indicated by the double headed arrows 92, which raises and lowers the main conveyor away from and toward the work table 85.

Conveyor housing 94 (a portion of which is broken away for clarity) is mounted to support arms 82 and 83, and endless conveyor belt 95 extends about conveyor belt rollers 96 and 97, with the rollers being rotatably supported by conveyor housing 94. Drive motor 99 is mounted on support arm 82 and its drive belt 100 is arranged in driving relationship with respect to conveyor roller 96.

When the pneumatic cylinders 90 contract and pull the rear end portions of the support arms 82 and 83 downwardly, the conveyor housing 94 and its conveyor belt 95 are raised away from the surface of the work table 85. Conversely, when the pneumatic cylinders 90 are distended, the rear ends of the support arms 92 and 93 are raised away from the work table 85, causing the conveyor housing 94 and conveyor belt 95 to be moved downwardly toward the work table. A relatively smooth, flat work plate 102 is attached to the surface of work table 85, directly beneath the conveyor belt 95, so that the conveyor belt and the work pieces moved by the conveyor belt move with only small frictional forces against the work plate 102.

Tilt conveyor 81 is mounted to conveyor housing 94 of main conveyor 80, and comprises conveyor belt support arm 104 (partially broken away in FIG. 1), endless conveyor belt 105 and belt sheaves 106, 107 and 108. The conveyor belt 105 is driven through its belt sheave 108, and its belt sheave 108 is driven in unison with conveyor roller 97 of main conveyor 80. Thus, the lower runs of both conveyor belts 95 and 105 operate in unison.

Tilt cylinder 110 is mounted to conveyor housing 94 by bracket 111, and its cylinder rod 112 is connected to conveyor belt support arm 104. When cylinder rod 112 is retracted within the tilt cylinder 110, the tilt conveyor 81 tilts upwardly away from the working surface 24. This enables the operator to lift the tilt conveyor completely away from the working surface 24, as when placing a work piece at the sewing area at the beginning of the sewing function. Moreover, when main conveyor 80 is raised or lowered with respect to work table 85, tilt conveyor 81 can be lowered or raised so as to compensate for the movement of the main conveyor. With this arrangement, the tilt conveyor 81 can retain working contact with a work piece that is to be moved along the working surface 24 even through main conveyor 80 is being moved up or down.

Stacker 15 (FIG. 1) includes a collector tray 115 and a tilt plate 116. Tilt plate 116 includes an upper edge 118 that is positioned parallel to and below the common edges 120 of the work table 85 and its work plate 102, and the tilt plate 116 is pivoted at its lower portion about horizontal axle 121. Pneumatic cylinder 122 is positioned beneath work table 85 and its cylinder rod is attached to and controls the movements of tilt plate 116, as indicated by double headed arrow 124. With this arrangement, the upper edge 118 of tilt plate 116 is movable from a position as shown, beneath the edge of the work table 85, to a sloped, tilted position which is extended over the collector tray 115.

Figure 8:
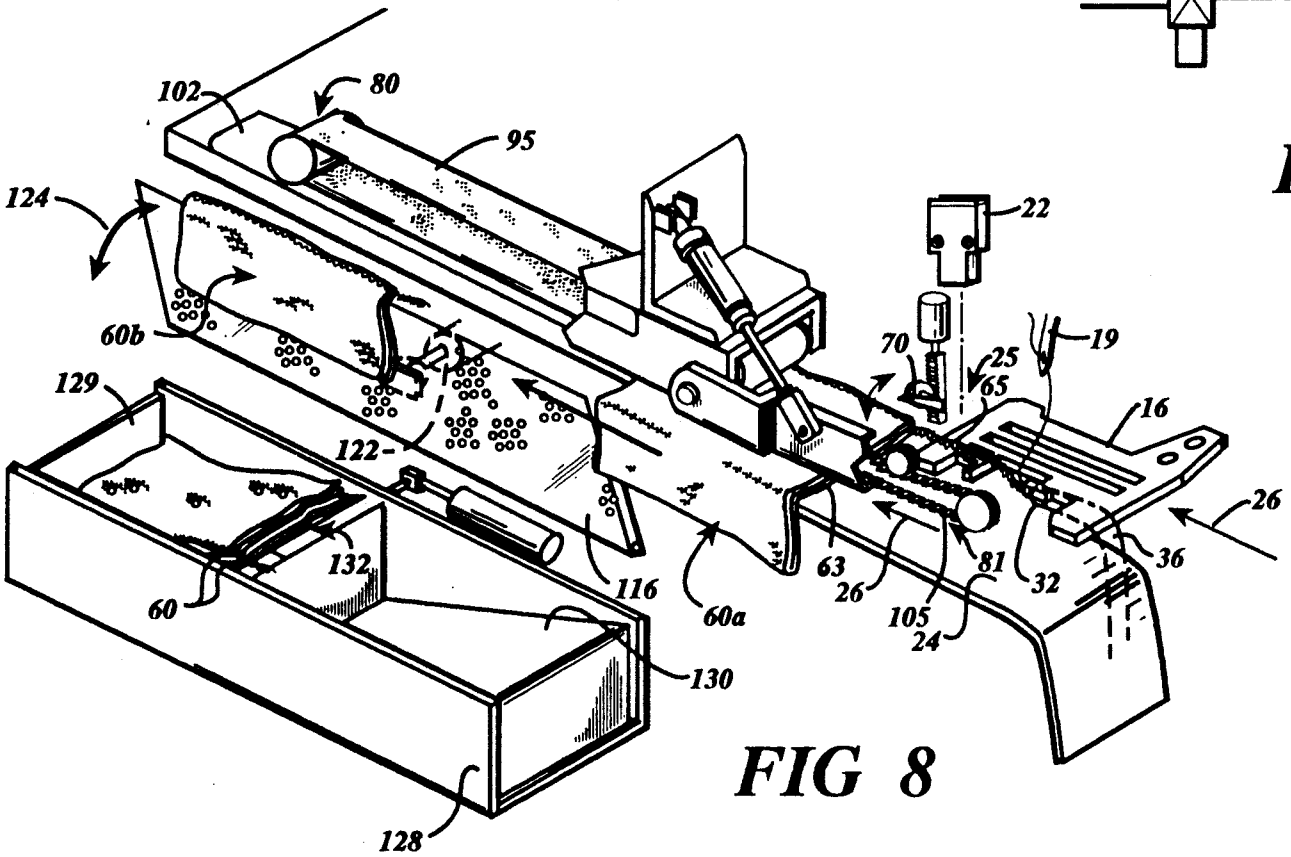
FIG. 8 is a schematic perspective illustration of the process performed by the sewing machine, conveyor and stacker, illustrating how the work pieces are moved from the needle of the sewing machine to the stacking tray.

As illustrated in FIG. 8, when a work piece **60*a* moves beyond the sewing area under the influence of the tilt conveyor 81, the photoelectric detector 22 will detect the movement of the trailing edge 63 of the work piece 60*a*, and the velocity of the tilt conveyor 81 and main conveyor 80 will increase so as to stretch the thread chain 65 (FIG. 7) and begin the cutting function of the chain cutter 70 and to initiate the air stream through the hollow chaining tongue 32. Once the thread chain 65 has been severed as previously described, the work piece 60*a* is moved to the position of work piece 60*b* (FIG. 8), by moving along the remaining length of tilt conveyor 81 and along the length of main conveyor 80 until the work piece reaches the position of work piece 60*b*. Cylinders 90 are retracted so as to lift the main conveyor 80 upwardly away from the work table 85, releasing the work piece 60*b* from the work table, and the pneumatic cylinder 122 tilts the tilt plate 116 as indicated by arrows 124. As the tilt plate 116 tilts, it sweeps the work piece 60*b* laterally and downwardly, and when the motion of the tilt plate terminates, the work piece 60*b* continues to travel through a downward arc so as to be collected in a neat stack 132 of the work pieces in the internal tray 129 or 130**.

Collector tray 115 includes a U-shaped base tray 128 and a pair of internal trays 129 and 130 which are removably positioned in the U-shaped base tray. Pneumatic cylinder 131 has its cylinder rod connected to U-shaped base tray 128 and is arranged to move the collector tray 115 in a path from the position illustrated in FIG. 1 to a position closer to the operator positioned at the controls 20, 21 of the sewing machine 12, so the operator can remove the work pieces collected in the collector tray. The operation of main conveyor 80 is controlled so as to deliver the work pieces from different positions along the run of the conveyor. For example, when short work pieces are being processed by the system the work pieces first will be moved by the main conveyor 80 to a position adjacent one of the internal trays 129 or 130, and after a predetermined number of work pieces have been moved by the tilt plate 116 into the internal tray, the main conveyor will move the subsequent work pieces to a position adjacent the other internal tray 129 or 130 so that the tilt plate 116 begins to fill the other internal tray with work pieces. When long work pieces are being processed, the internal trays can be removed and the U-shaped base tray can collect the work pieces.

Figure 9:
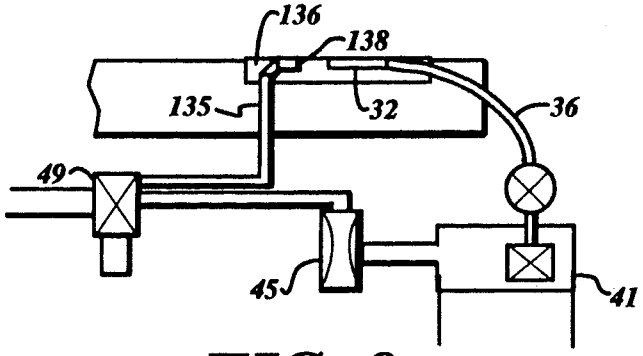
FIG. 9 is a schematic illustration of an alternate air control system of the sewing machine.

As schematically illustrated in FIG. 9, a blow tube 135 can be used in conjunction with the hollow chaining tube 32, if desired. The blow tube 135 is mounted to the throat plate 136 with its open end 138 directed toward the open end of the chaining tongue 32. The control valve 49 that admits high pressure air to the Venturi constrictor 45 also can be utilized to admit high pressure air to the blow tube 135, or a separate valve can be used for this purpose, if desired. Thus, as the canister 41 draws a stream of air through the hollow chaining tube 32, the blow tube 135 will emit a stream of air across the sewing area toward the opening of the hollow chaining tube, tending to further assist the movement of the free end of the thread chain toward the inlet of the hollow chaining tongue.

Thus, it can be seen that the present invention comprises a useful and effective method and apparatus for oversewing or forming a "latch back" into a work piece of the excess thread chain of an overlock stitch. While the invention has been shown and described as what is presently believed to be the most practical and preferred embodiments thereof, it will be apparent that modifications and variations within the scope and spirit of the invention are possible, and that the invention is to be afforded its broadest interpretation so as to encompass all equivalents thereof. For example, it is possible to use other types of cutting means rather than the specific cutters disclosed herein for cutting and trimming the thread chain, and while the overlock stitch has been specifically described herein as the type of stitch formed by the sewing machine, the latch back system can be used with other types of stitches, if desired.

We claim:

1. A sewing machine comprising:

a work surface defining a sewing area and a path of travel for a work piece through the sewing area;

sewing needles in the sewing area for sewing a continuous overlock stitch into a work piece and forming excess thread chain between a trailing edge of a previously sewn work piece and said sewing needles;

severing means in the path of the work piece for cutting the excess thread chain to create on each cycle of the sewing machine a severed leading thread chain of a predetermined length extending from said sewing needle, said severing means comprising at least one cutting member for cutting across said path of travel of the work piece;

conveying means for advancing the work piece along the path of travel and beyond the sewing area and for stretching the excess thread chain prior to said severing means cutting the excess thread chain to pull the thread chain taut as the thread chain is cut so as to cause the free end of the cut thread chain to recoil toward the sewing needles;

a chaining tongue in the sewing area about which the sewing needles form the overlock stitch, said chaining tongue defining an air passage therethrough and including an open end adjacent the sewing area for receiving the free end of the severed leading thread chain extending from said sewing needles and for positioning the free end of the leading thread chain in a position to be oversewn in a second work piece, said open end of said chaining tongue being positioned between ½ and 1½ inches from said severing means for forming the leading thread chain at a predetermined length;

air induction means for inducing a stream of air to flow into said open end of said chaining tongue for drawing the free end of the leading thread chain into said chaining tongue; and detector means responsive to the trailing end of the work piece moving through said sewing area to actuate said conveying means, said severing means and said air induction means in timed relationship with one another.

2. A sewing machine as claimed in claim 1 wherein said air induction means for inducing a stream of air to flow into the open end of said chaining tongue comprises a housing defining a vacuum reservoir chamber, means for evacuating said vacuum reservoir chamber, and valve means responsive to said detector means for intermittently connecting said vacuum reservoir chamber to said hollow chaining tongue in timed relationship with respect to the movement of a work piece through the sewing area.

3. A sewing machine as claimed in claim 2 wherein said vacuum reservoir chamber has an internal volume of at least about 400 cubic inches.

4. A sewing machine as claimed in claim 1 and wherein said sewing machine is responsive to the detection by said detector means of the trailing end of the work piece to continue the operation of the sewing machine to a time after the severing means cuts the excess thread chain whereby thread chain is formed about said chaining tongue and is in motion at the open end of the chaining tongue after the excess thread chain has been cut.

5. The sewing machine as claimed in claim 1 and wherein said conveying means is responsive to said detector means for advancing the work piece beyond the sewing area at a velocity that causes tension in the thread chain extending from the work piece to the sewing needles.

6. A sewing machine as claimed in claim 1 and further including a stacker adjacent said conveying means for receiving and stacking the work pieces, said stacker including a receiving tray positioned below and to one side of said conveying means, a tilt plate member including an upper edge positioned beneath and extending along said conveying means for receiving work pieces draped thereover, means for moving said upper edge of said tilt plate member out from beneath said conveying means and over said receiving tray for transferring the work pieces from the conveying means to said receiving tray.

7. A sewing machine as claimed in claim 6 wherein said receiving tray comprises at least two compartments for receiving work pieces at different positions.

8. A sewing machine comprising:

advancing means for moving the work piece along a sewing path through and beyond a sewing area, sewing needles in the sewing area for sewing a continuous overlock stitch or the like in the work piece moved along the sewing path through the sewing area whereby excess thread chain is created and extends along the sewing path between a trailing edge of a previously sewn work piece and said sewing needles;

said advancing means including means for applying tension to the excess thread chain;

severing means positioned in the sewing path for cutting the excess thread chain with the excess thread chain stretched taut from the needles to the previously sewn work piece to create a severed leading thread chain of a predetermined length extending from said sewing needles;

a chaining tongue positioned for receiving thereabout the overlock stitch formed by the sewing needles and including an open end at the position of said sewing needles for receiving a free end of the severed leading thread chain extending from said sewing needles;

vacuum means for inducing a stream of air to flow into said chaining tongue and drawing the free end of the leading thread chain into said chaining tongue; and detector means responsive to the trailing end of the work piece moving through the sewing area for actuating said severing means and for continuing the operation of the sewing machine to a time after the severing means cuts the thread chain to maintain the thread chain in motion at the opening of the chaining tongue;

whereby the excess thread chain extending from the sewing needles to the work piece along the sewing path is stretched as it is cut and the cut end of the severed leading thread chain recoils toward the chaining tongue and is drawn into the open end of the chaining tongue by the stream of air.

9. A sewing machine as claimed in claim 8 wherein said severing means is spaced from said sewing needle a distance for forming a leading thread chain of a length suitable to be drawn by the stream of air moving into said chaining tongue.

10. A sewing machine as claimed in claim 9 wherein said length is between ½ inch and 1½ inches.

11. A sewing machine as claimed in claim 8 wherein said severing means is adapted to cut perpendicularly to the sewing path.

12. A sewing machine as claimed in claim 8 wherein said vacuum means comprises a vacuum canister, a means for creating a reduced air pressure in said vacuum canister, and control means responsive to said detector means for intermittently connecting said vacuum canister to said chaining tongue in timed relationship with respect to the movement of a work piece along said sewing path through said sewing area.

13. A sewing machine as claimed in claim 8 wherein said severing means is adapted to create a trailing thread chain extending from the trailing edge of a previously sewn work piece, said sewing machine further comprising vacuum knife means including a vacuum conduit for inducing a stream of air to flow laterally of the sewing path to draw the trailing thread chain laterally of the sewing path, and cutting means positioned beside the sewing path for trimming the trailing thread chain extending laterally of the sewing path.

14. The sewing machine as claimed in claim 8 and further including a blow tube for directing a stream of air toward said chaining tongue.

15. Apparatus for use with a sewing machine including sewing needles in a sewing area for sewing an overlock stitch or the like about a chaining tongue and into a series of work pieces moving along a path through said sewing needles whereby a thread chain is created between a trailing edge of the previously sewn work piece and the sewing needles, said apparatus comprising:

detector means for determining when the trailing edge of a work piece moves beyond the sewing needle, conveyor means responsive to said detector means for moving the previously sewn work piece away from the sewing needles at a velocity greater than the rate at which the stitch is formed for applying tension to the thread chain extending between the previously sewn work piece and said sewing needles to require the thread chain to extend along the path, severing means responsive to said detector means for cutting the thread chain extending along the path from the sewing needles to the previously sewn work piece while tension is applied to the thread chain to create a severed trailing thread chain extending from the trailing edge of the previously sewn work piece and a severed leading thread chain of a predetermined length extending from the sewing needles and causing the severed leading thread chain to recoil toward the sewing needles, and means for drawing off the free end of the severed leading thread chain extending from the sewing needles and for positioning the free end of the leading thread chain in a position to be oversewn into the beginning of the stitching in a second work piece, comprising a passage through said chaining tongue including an open end adjacent the sewing area, and air induction means responsive to said detector means for inducing a stream of air to flow into said open end of said chaining tongue passage in timed relationship with the cutting of the thread chain, when by the free end portion of the leading thread chain extending from the sewing needles recoils from the severing means toward the chaining tongue and is drawn into the passage through the chaining tongue by the stream of air.

16. An apparatus as claimed in claim 15 wherein said means for inducing a stream of air to flow into the open end of said hollow chaining tongue comprises a vacuum reservoir chamber of at least 400 cubic inches, a venturi means for creating a reduced air pressure in said vacuum reservoir chamber, and valve means responsive to said detector means for intermittently connecting said vacuum reservoir chamber to said hollow chaining tongue.

17. An apparatus as claimed in claim 15 further comprising control means responsive to said detector means for continuing and later halting the sewing action of the sewing machine and for cutting the thread chain while the sewing action continues.

18. An apparatus as claimed in claim 17 wherein said detector means for detecting completion of the first work piece comprises an optical detector means, said optical detector means being adapted to detect the trailing edge of the work piece.

19. An apparatus as claimed in claim 15 further comprising trimming means for trimming the severed trailing thread chain extending from the trailing edge of the previously sewn work piece.

20. An apparatus as claimed in claim 19 wherein said trimming means comprises a vacuum knife positioned adjacent the path of movement of work pieces through the sewing machine.

21. An apparatus as claimed in claim 15 wherein said severing means is positioned at a distance from said chaining tongue between approximately ½ inch to 1½ inches.

22. An apparatus as claimed in claim 15 and wherein said means for drawing off and positioning the free end of the leading thread chain further includes a hollow member connected to a source of compressed air, said hollow member including an opening being proximate to and facing said open end of said chaining tongue adjacent the sewing area, whereby an air stream is projected from the opening of said hollow member toward said chaining tongue to help introduce the severed leading thread chain into the passage through the chaining tongue.

23. A method of sewing a portion of a thread chain, extending from the sewing needles of a sewing machine to a previously sewn work piece, to a second work piece to eliminate any significant knot or thread chain at the leading edge of the second work piece, said method comprising the steps of:

moving a first work piece along a sewing path of the sewing machine;

forming an overlock stitch about a hollow chaining tongue with the sewing needles of the sewing machine in the first work piece as the first work piece moves through the sewing path and sewing off the first work piece to form a thread chain extending from the first work piece to the sewing needles;

sensing the completion of sewing of the first work piece which has moved along the sewing path of the sewing machine;

in response to sensing the completion of sewing the first work piece, drawing taut the thread chain extending from the first work piece to the sewing needles;

while the thread chain is taut, cutting the thread chain extending between the needles of the sewing machine and the first work piece in response to sensing the completion of sewing of the first work piece in a manner to create a leading thread chain of a predetermined length extending from the sewing needles that recoils toward the hollow chaining tongue;

drawing off the free end of the leading thread chain extending from the sewing machine needles into the hollow chaining tongue in such a manner as to cause the excess thread chain to extend below the sewing path of the sewing machine;

continuing to form an overlock stitch with the needles of the sewing machine about the chaining tongue as the thread chain is drawn into the hollow chaining tongue, advancing the second work piece along the sewing path toward the sewing machine needles while the leading thread chain is drawn into the hollow chaining tongue until the second work piece is engaged in the sewing needles;

simultaneously forming an overlock stitch in the second work piece and progressively oversewing the drawn off leading thread chain in the overlock stitch.

24. A method as claimed in claim 23 wherein the step of drawing off the free end of the leading thread chain comprises applying a source of reduced air pressure to the hollow chaining tongue during the step of cutting the thread chain.

25. The method of claim 23 and wherein the step of drawing off the free end of the leading thread chain comprises moving a stream of air about the threads of the leading thread chain and into the hollow chaining tongue as the needles of the sewing machine continue to form an overlock stitch about the chaining tongue.

26. The method of claim 23 and wherein the step of drawing taut the thread chain comprises advancing the work product with a conveyor away from the sewing needles at a velocity greater than the rate at which the thread chain is formed by the sewing needles.

27. A work piece having an overlock stitch formed therein by the method of claim 23.

28. A method of sewing a portion of a thread chain, extending from the sewing needles and the hollow chaining tongue of a chain stitch sewing machine toward a previously sewn first work piece, to a second on-coming work piece to eliminate any significant thread knot or thread chain protruding from the leading edge of the second work piece, comprising the steps of:

forming a chain stitch in the first workpiece and forming a thread chain extending from the first workpiece, cutting the thread chain to a predetermined length extending from the chaining tongue, stretching the thread chain away from the chaining tongue to a predetermined extent before the thread chain is cut so as to create a recoil of the cut end portion of the thread chain back toward the opening of the chaining tongue, applying a vacuum at a predetermined pressure range to an opening of the chaining tongue so as to form a uniform air flow into and through the chaining tongue during each cycle of operation of the sewing machine, and continuing the formation of the chain stitch about the chaining tongue after the cutting step is performed so that the thread chain is in motion at the opening of the chaining tongue as the thread chain recoils toward the opening of the chaining tongue.

* * * * *